US010087814B2

(12) United States Patent
Lee

(10) Patent No.: US 10,087,814 B2
(45) Date of Patent: Oct. 2, 2018

(54) WATER-JACKET STRUCTURE OF CYLINDER HEAD AND METHOD FOR OPERATING THE SAME

(71) Applicants: HYUNDAI MOTOR COMPANY, Seoul (KR); KIA MOTORS CORPORATION, Seoul (KR)

(72) Inventor: Byung-Soo Lee, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 152 days.

(21) Appl. No.: 15/342,458

(22) Filed: Nov. 3, 2016

(65) Prior Publication Data

US 2017/0268406 A1 Sep. 21, 2017

(30) Foreign Application Priority Data

Mar. 16, 2016 (KR) ..... 10-2016-0031330

(51) Int. Cl.

| | |
|---|---|
| ***F02F 1/36*** | (2006.01) |
| ***F02F 1/42*** | (2006.01) |
| ***F01P 3/02*** | (2006.01) |
| ***F02F 1/10*** | (2006.01) |

(52) U.S. Cl.
CPC *F01P 3/02* (2013.01); *F02F 1/10* (2013.01); *F01P 2003/027* (2013.01)

(58) Field of Classification Search
CPC ..... F01P 3/02; F01P 2003/027; F02F 1/10; F02F 1/4285; F02F 1/38; F02F 2001/248; F02F 1/40; F02F 1/36
USPC ..... 123/41.82 R, 41.34, 193.5
See application file for complete search history.

(56) References Cited

U.S. PATENT DOCUMENTS

| | | | | |
|---|---|---|---|---|
| 7,086,357 | B2 * | 8/2006 | Mac Vicar | F01P 3/02 123/193.5 |
| 2004/0139933 | A1 * | 7/2004 | Obermayer | F01P 3/16 123/41.82 R |
| 2009/0133647 | A1 * | 5/2009 | Yamagata | F01P 3/16 123/41.82 R |

(Continued)

FOREIGN PATENT DOCUMENTS

| | | |
|---|---|---|
| JP | 2009-052439 A | 3/2009 |
| JP | 2014-084738 A | 5/2014 |

(Continued)

*Primary Examiner* — Syed O Hasan
(74) *Attorney, Agent, or Firm* — McDermott Will & Emery LLP

(57) ABSTRACT

A water-jacket structure of a cylinder head may include a plurality of intake side inlet passages installed at intake sides of the cylinder head, respectively, along a length direction of the cylinder head to introduce cooling water supplied from the water-jacket of a cylinder block into the water-jacket of the cylinder head, a combustion chamber cooling passage cooling a combustion chamber using the cooling water supplied from the intake side inlet passage, a plurality of exhaust side outlet passage disposed at exhaust sides of the cylinder head, respectively, along a the length direction of the cylinder head to discharge the cooling water passing through the combustion chamber cooling passage, and an exhaust side gallery communicating with the exhaust side outlet passage to gather the cooling water discharged from the exhaust side outlet passage.

14 Claims, 7 Drawing Sheets

(56) References Cited

U.S. PATENT DOCUMENTS

2015/0204267 A1* 7/2015 Lazich ..... F01P 3/02
123/193.5

FOREIGN PATENT DOCUMENTS

KR 10-1997-0006789 A 2/1997
KR 10-2007-0064970 A 6/2007
KR 10-0921127 B1 10/2009

* cited by examiner

WATER-JACKET STRUCTURE OF CYLINDER HEAD AND METHOD FOR OPERATING THE SAME

CROSS-REFERENCE TO RELATED APPLICATIONS

This application claims the benefit of priority to Korean Patent Application No. 10-2016-0031330, filed on Mar. 16, 2016, which is incorporated herein by reference in its entirety.

TECHNICAL FIELD

The present disclosure relates to a water-jacket structure of a cylinder head and a method for operating the same, and more particularly, to a water-jacket structure of a cylinder head and a method for operating the same capable of efficiently controlling an engine by preventing a deviation in surface temperature between the respective cylinders by reducing a flow resistance and strengthening a cross-flow.

BACKGROUND

In general, a vehicle engine includes a cylinder block including a plurality of cylinder bores through which a piston may be reciprocated and a cylinder head coupled to an upper part of the cylinder block to form a combustion chamber along with the piston and including a plurality of intake and exhaust ports for an installation for various kinds of intake and exhaust valves.

In the engine, a water-jacket for flowing cooling water to a circumference of the cylinder bore, a circumference of the combustion chamber, and a circumference of the intake and exhaust ports are installed in the cylinder block and the cylinder head. The water-jacket guides the flow of cooling water discharged from a water pump to the whole area in the cylinder block and the cylinder header to keep an operating temperature of the engine normal over the whole operation area of the engine.

That is, the water-jacket servers as a flow passage of cooling water to prevent main parts such as the cylinder block, the cylinder head, and the piston from suffering from thermal damage due to heat of maximum temperature (approximately 2500° C.) generated during a combustion process of a gas mixture within the combustion chamber.

Hereinafter, the existing water-jacket of the cylinder head will be described in detail with reference to the accompanying drawings. FIG. 1 is a diagram illustrating the problem of the related art. Referring to FIG. 1, the existing water-jacket of the cylinder head is formed at an intake side and an exhaust side in a length direction of the cylinder head. That is, the cooling water in the existing water-jacket of the cylinder head forms a parallel-flow. Therefore, the flow of cooling water cooling each cylinder is non-uniform. Further, when the cylinder is cooled by the parallel-flow, the deviation in the surface temperature between the cylinder first cooled with the cooling water due to an increase in cooling water temperature and the cylinder finally cooled occurs. Therefore, it is difficult to efficiently control the engine.

Further, a passage is formed to pass two flows of cooling water forming the parallel-flow therethrough, and therefore, cross sectional areas of the respective passages are increased. Therefore, there is a problem in that the flow of cooling water is not concentrated around the combustion chamber to be concentratedly cooled, and therefore, the cooling efficiency may be reduced.

Further, the two flows of cooling water forming the parallel-flow are discharged to the outside of the cylinder header through one outlet for cooling water to cause the resistance of the flow of cooling water, thereby reducing the cooling efficiency.

SUMMARY

An embodiment of the present disclosure is directed to a division of a cooling passage of a combustion chamber into an upper passage and a lower passage and an installation of a flow guide partition wall to increase a flow of cooling water passing through a circumference of a combustion chamber (in particular, circumference of an exhaust port hole) to be actually cooled.

Another embodiment of the present disclosure is directed to an increase in a cross sectional area of an exhaust side outlet passage and an installation of an exhaust side gallery to guide cooling water to be smoothly discharged outside a cylinder head, thereby reducing a flow resistance and strengthening a cross-flow.

Other objects and advantages of the present disclosure can be understood by the following description, and become apparent with reference to the embodiments. In addition, it is obvious to those skilled in the art to which the present disclosure pertains that the objects and advantages of the present disclosure can be realized by the means as claimed and combinations thereof.

In accordance with an embodiment of the present disclosure, a water-jacket structure of a cylinder head includes: a plurality of intake side inlet passages installed at intake sides of the cylinder head, respectively, along a length direction of the cylinder head to introduce cooling water supplied from the water-jacket of a cylinder block into the water-jacket of the cylinder head; a combustion chamber cooling passage cooling a combustion chamber using the cooling water supplied from the intake side inlet passage; a plurality of exhaust side outlet passage disposed at exhaust sides of the cylinder head, respectively, along a the length direction of the cylinder head to discharge the cooling water passing through the combustion chamber cooling passage; and an exhaust side gallery communicating with the exhaust side outlet passage to gather the cooling water discharged from the exhaust side outlet passage.

The water-jacket structure of a cylinder head may further include: a cooling water outlet communicating with one side of the exhaust side gallery to discharge the cooling water gathered into the exhaust side gallery to an outside of the cylinder head.

A cross sectional area of the exhaust side outlet passage may be larger than that of the intake side inlet passage.

The combustion chamber cooling passage may be formed to enclose an intake port hole, an exhaust port hole, and a spark plug hole.

The combustion chamber cooling passage may include an upper passage and a lower passage that are divided by an upper and lower dividing partition wall.

The water-jacket structure of a cylinder head may further include: flow guide partition walls vertically disposed at both sides of the spark plug hole of the lower passage to form the cross-flow in which the cooling water introduced from the plurality of intake side inlet passages into the lower passage flows in a width direction of the cylinder head to cool the respective combustion chambers and then is discharged to the plurality of exhaust side outlet passages.

The lower passage and the upper passage may communicate with each other by bypassing the upper and lower dividing partition wall to introduce air in the lower passage into the upper passage.

The upper passage may be formed in the length direction the cylinder head to form a parallel-flow in which the air introduced from the lower passage into the upper passage and the cooling water introduced along with the air flow in the length direction of the cylinder head.

The water-jacket structure of a cylinder head may further include: a ventilation passage through which the upper passage and the cooling water outlet communicate with each other to discharge the air and the cooling water forming the parallel-flow at the upper passage to the cooling water outlet.

A cross sectional area of the ventilation passage may be smaller than a minimum cross sectional area of the upper passage.

Cross sectional areas of the lower passages at both sides of the spark plug hole may be smaller than that of the lower passage at the intake side of the cylinder head.

The flow guide partition wall may increase the flow of the cooling water enclosing the exhaust port hole during the cross-flow.

The flow guide partition wall may have a hexagonal prism shape in which a length in a width direction of the cylinder head is longer than a length in the length direction of the cylinder head.

In the flow guide partition wall, an area of a side surface of the intake side of the cylinder head may be larger than that of a side surface of the exhaust side of the cylinder head.

The flow guide partition wall may have a cross section in a V-letter form protruding toward the intake side of the cylinder head.

In accordance with another embodiment of the present disclosure, a method for operating a water-jacket structure of a cylinder head includes: supplying cooling water to an intake side inlet passage; cooling, by the cooling water supplied from the intake side inlet passage, a combustion chamber while passing through an inside of a combustion chamber cooling passage; a first discharge step of discharging the cooling water passing through the combustion chamber cooling passage through an exhaust side outlet passage; and gathering the cooling water discharged from the exhaust side outlet passage into an exhaust side gallery.

The method may further include: a second discharge step of discharging the cooling water gathered into the exhaust side gallery to an outside of the cylinder head through a cooling water outlet.

The cooling may include forming a cross-flow in which the cooling water introduced into a lower passage cools the respective combustion chambers by the flow guide partition walls vertically disposed at both sides of the spark plug hole of the lower passage, forming a parallel-flow in which air introduced into the upper passage by bypassing the upper and lower dividing partition wall at the lower passage and the cooling water introduced along with the air flow in a length direction of the cylinder head, and a third discharge step of discharging the air and the cooling water forming the parallel-flow at the upper passage to the cooling water outlet through a ventilation passage.

DETAILED DESCRIPTION

Terms and words used in the present specification and claims are not to be construed as a general or dictionary meaning but are to be construed meaning and concepts meeting the technical ideas of the present disclosure based on a principle that the inventors can appropriately define the concepts of terms in order to describe their own inventions in best mode. Therefore, the configurations described in the exemplary embodiments and drawings of the present disclosure are merely examples but do not represent all of the technical spirit of the present disclosure. Thus, the present disclosure should be construed as including all the changes, equivalents, and substitutions included in the spirit and scope of the present disclosure at the time of filing this application. In the present specification, an overlapped description and a detailed description for well-known functions and configurations that may obscure the gist of the present disclosure will be omitted. Hereinafter, exemplary embodiments will be described in detail with reference to the accompanying drawings.

Figure 1:
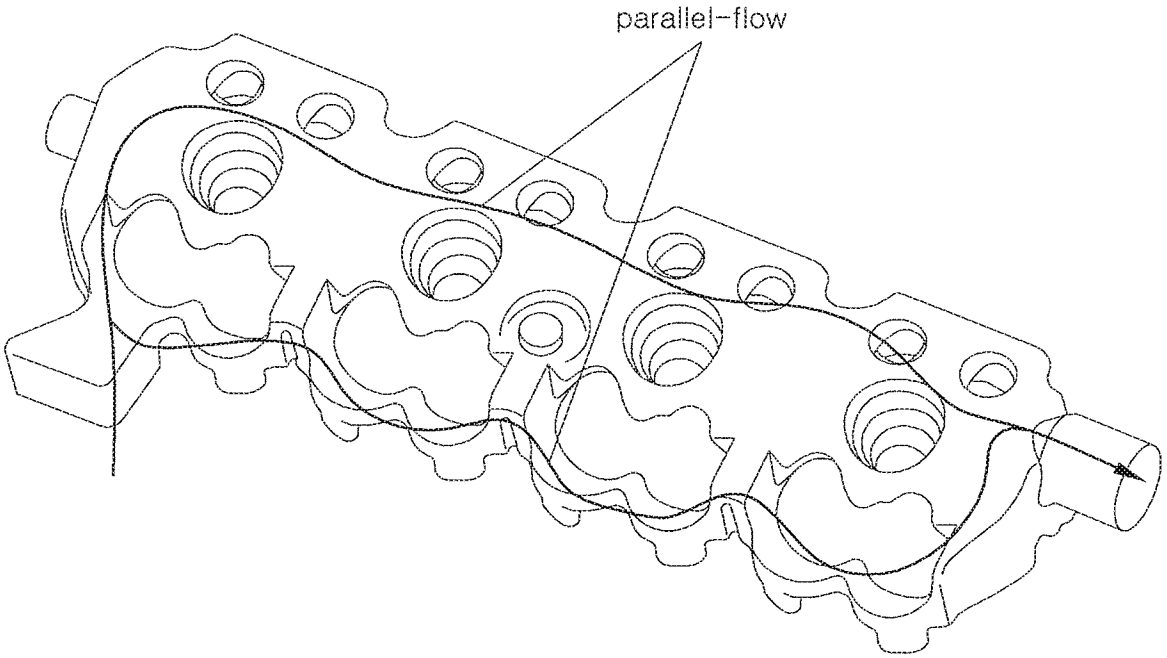
FIG. 1 is a diagram illustrating the problem of the related art.
Figure 2:
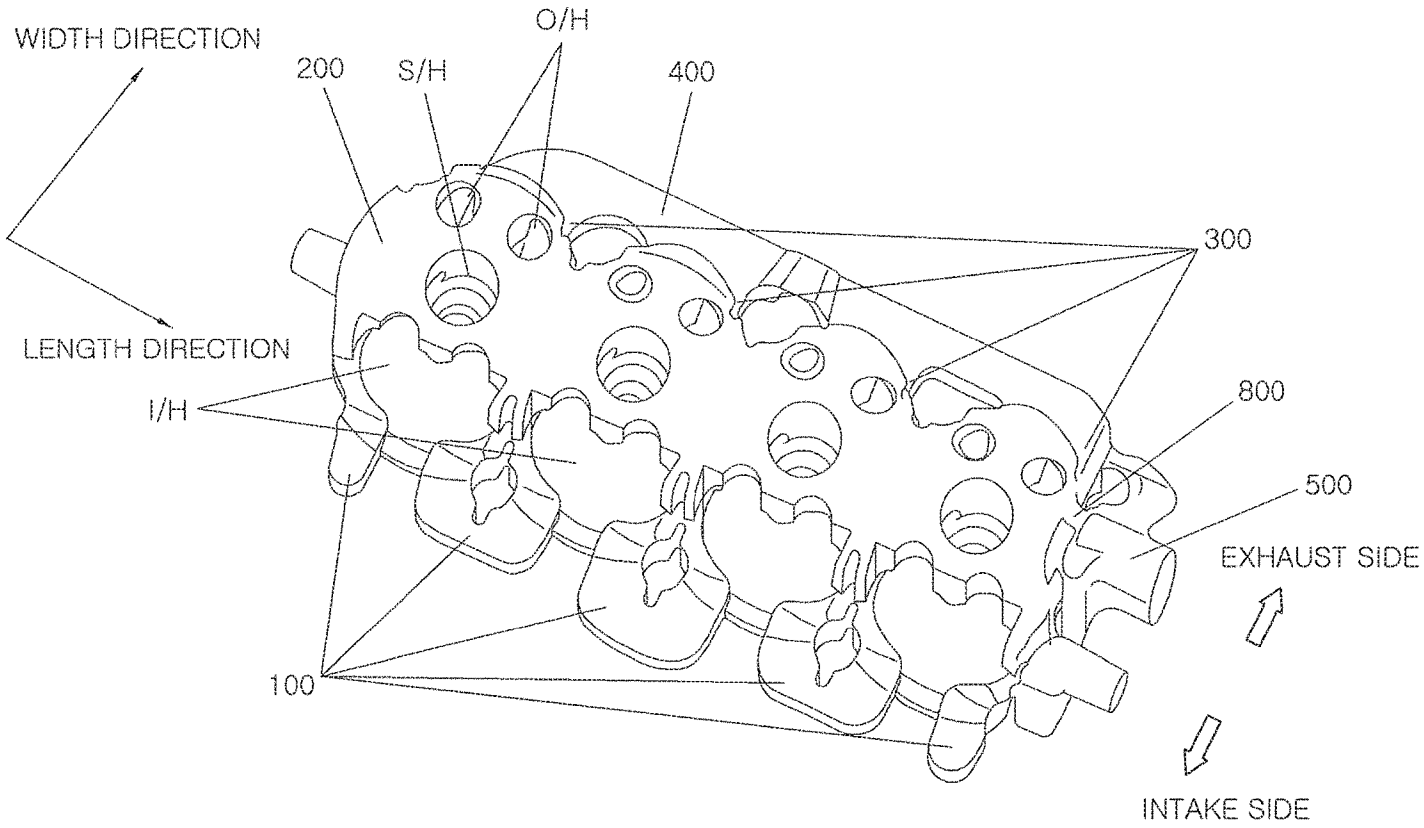
FIG. 2 is a perspective view of a water-jacket structure of a cylinder head according to an exemplary embodiment of the present disclosure.
Figure 3:
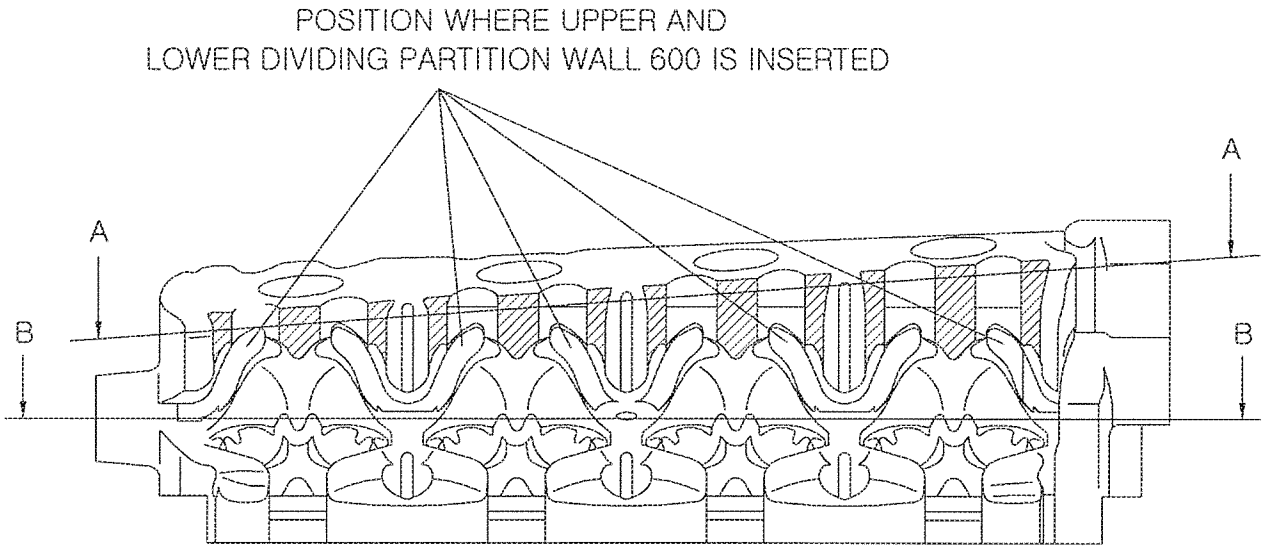
FIG. 3 is a side view of an intake side of FIG. 2.

FIG. 2 is a perspective view of a water-jacket structure of a cylinder head according to an exemplary embodiment of the present disclosure, and FIG. 3 is a side view of an intake side of FIG. 2. Referring to FIGS. 2 and 3, the water-jacket structure of a cylinder header according to the present disclosure includes an intake side inlet passage 100, a combustion chamber cooling passage 200, an exhaust side outlet passage 300, an exhaust side gallery 400, a cooling water outlet 500, an upper and lower dividing partition wall 600, a flow guide partition wall 700, and a ventilation passage 800.

The intake side inlet passages 100 are each disposed at the intake side of the cylinder head along a length direction of the cylinder header to introduce cooling water supplied from the water-jacket of a cylinder block into the cylinder head. The intake side inlet passage 100 may be plural.

Further, the combustion chamber cooling passage 200 serves to cool the combustion chamber using the cooling water supplied from the intake side inlet passage 100. The combustion chamber cooling passage 200 is formed to enclose an intake port hole I/H, an exhaust port hole O/H, and a spark plug hole S/H. That is, the combustion chamber cooling channel 200 is formed to enclose, in particular, a portion to be concentratedly cooled (that is, portion of which the surface temperature is relatively high), thereby preventing the portion from being thermally damaged.

In this case, the combustion chamber cooling passage 200 is divided into an upper passage 210 and a lower passage 220 by the upper and lower dividing partition wall 600. Further, the lower passage 220 and the upper passage 210 communicate with each other by bypassing the upper and lower dividing partition wall 600, and as a result air in the lower passage 220 may be introduced into the upper passage 210. The detailed description of the upper passage 210 and the lower passage 220 will be described below.

The exhaust side outlet passage 300 is disposed at the exhaust sides of the cylinder head, respectively, along the length direction of the cylinder head to discharge the cooling water passing through the combustion chamber cooling passage 200. Further, the exhaust side outlet passage 300 may be plural.

Further, the exhaust side gallery 400 communicates with the exhaust side outlet passage 300 and the cooling water discharged from the exhaust side outlet passage 300 is gathered into the exhaust side gallery 400.

In this case, the exhaust side gallery 400 is formed and a cross sectional area of the intake side inlet passage 100 is formed to be larger than that of the exhaust side outlet passage 300, such that a cross-flow at the combustion chamber cooling passage 200, in particular, the lower passage 220 is strengthened.

That is, the cross sectional area of the exhaust side outlet passage 300 is large and the exhaust side outlet passage 300 and the exhaust side gallery 400 communicate with each other, such that the cooling water introduced into the combustion chamber cooling passage 200 may be easily discharged. As a result, a flow resistance of the cooling water introduced into the combustion chamber cooling passage 200 is minimized to prevent an interference phenomenon between the flows of the cooling water in the respective cylinders, thereby strengthening the cross-flow. Therefore, it is possible to efficiently control the engine by preventing the deviation in the surface temperature between the respective cylinders.

The cooling water outlet 500 communicates with one side of the exhaust side gallery 400 to serve to discharge the cooling water gathered into the exhaust side gallery 400 to an outside of the cylinder head. Further, the cooling water outlet 500 communicates with a floating passage 210 via the ventilation passage 800 to be described below, and the detailed description of the floating passage will be described below.

Figure 4:
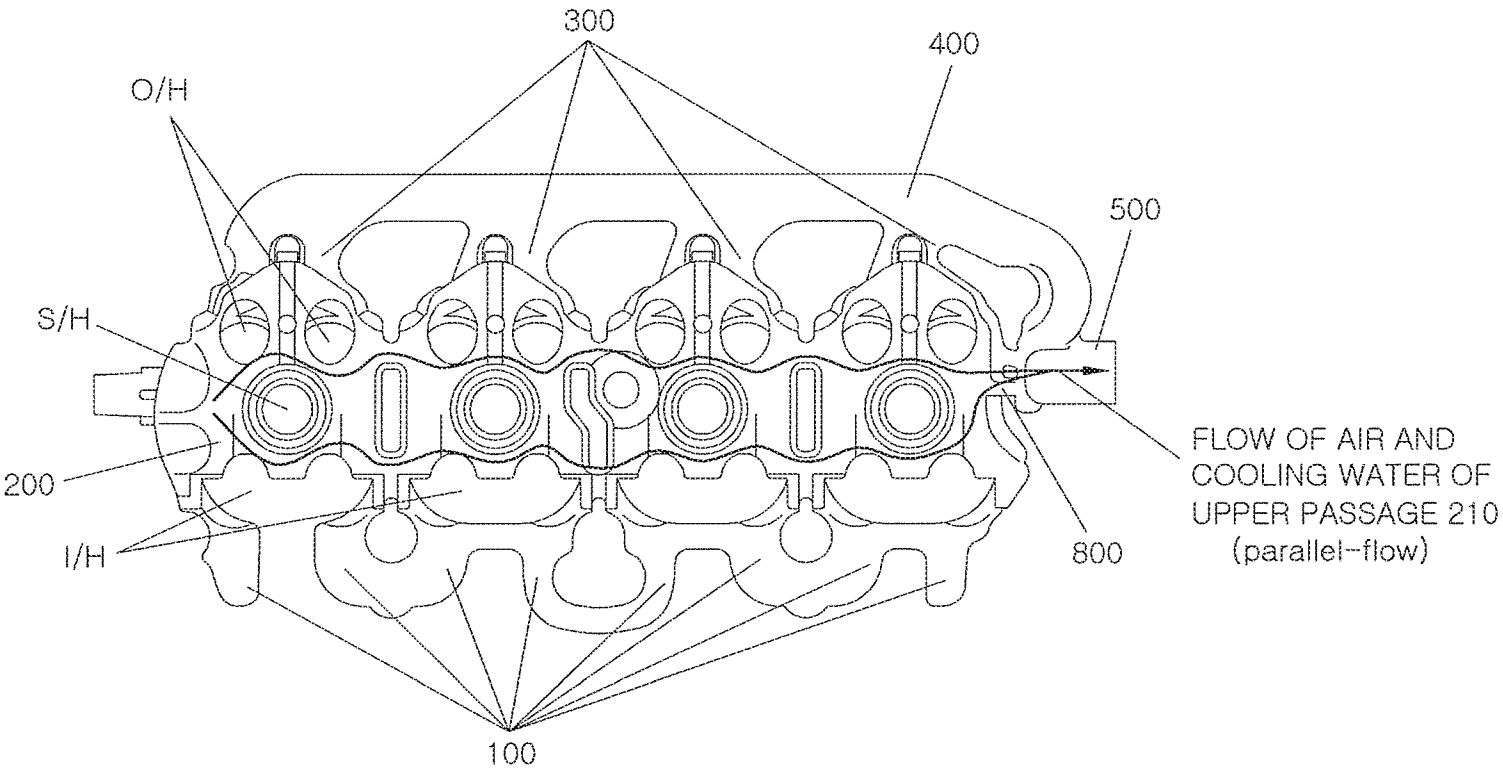
FIG. 4 is a cross sectional view taken along the line A-A of FIG. 3.
Figure 5:
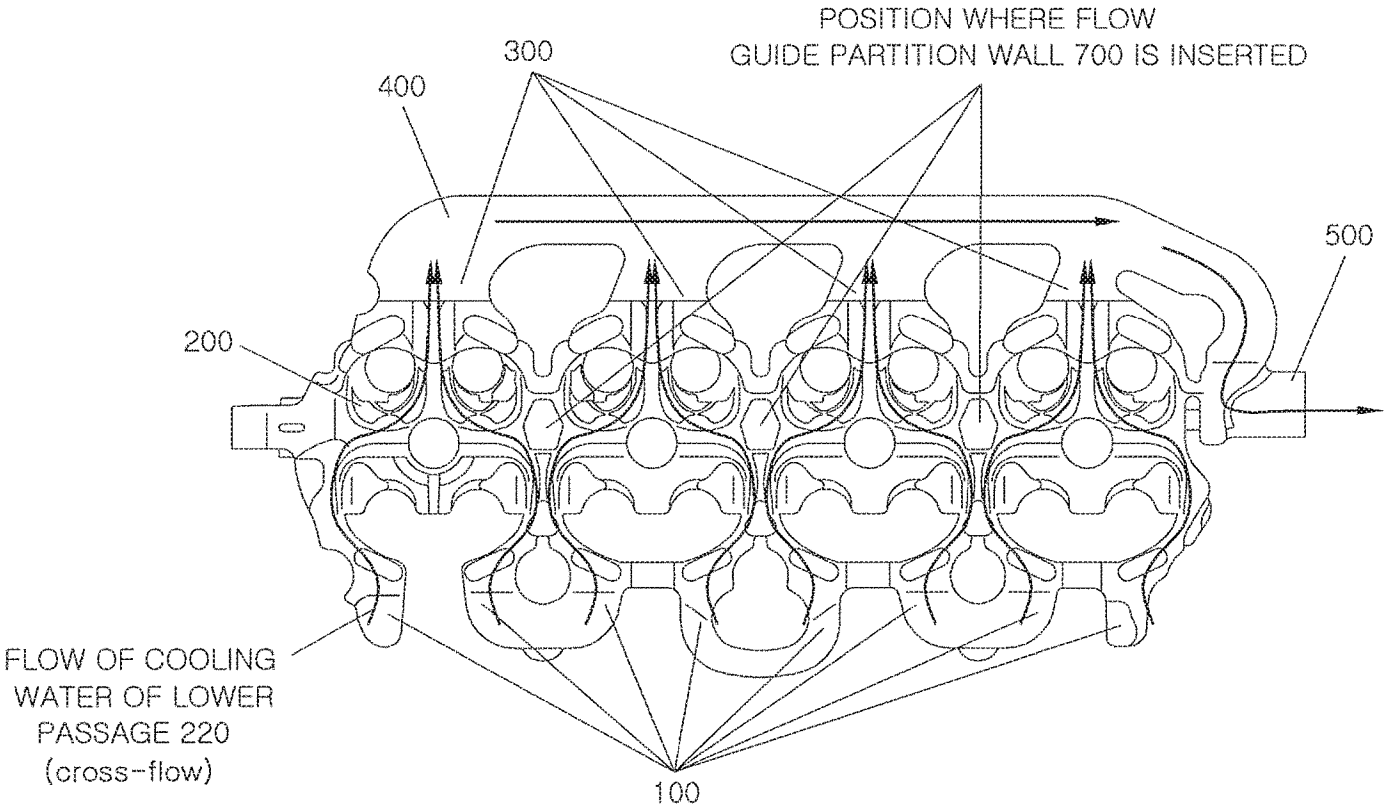
FIG. 5 is a cross sectional view taken along the line B-B of FIG. 3.

FIG. 4 is a cross sectional view taken along line A-A of FIG. 3; and FIG. 5 is a cross sectional view taken along line B-B of FIG. 3. Referring to FIGS. 4 and 5, in the lower passage 220, the cross sectional areas of the lower passages 220 at both sides of the spark plug hole S/H may be formed to be smaller than that of the lower passage 220 at the intake side of the cylinder head. Therefore, the flows of the cooling water at the spark plug hole S/H and the exhaust port hole O/H are concentrated, and as a result the cooling efficiency at the spark plug hole S/H and the exhaust port hole O/H is increased. That is, the exhaust port becomes the passage through which the high temperature exhaust gas generated from the respective combustion chambers is discharged. Therefore, this is to concentrate the flow of the cooling water on the circumference of the exhaust port hole O/H where the exhaust port of the cylinder head will be formed.

The flow guide partition wall 700 serves to form the cross-flow in which the cooling water introduced from the plurality of intake side inlet passages 100 into the lower passage 220 flows in a width direction of the cylinder head to cool the respective combustion chambers and then is discharged to the plurality of exhaust side outlet passages 300.

In this case, the flow guide partition walls 700 are vertically disposed at both sides of the spark plug hole S/H of the lower passage 220.

Further, the flow guide partition wall 700 is formed to increase the flow of the cooling water enclosing the exhaust port hole O/H during the cross-flow. That is, the exhaust port becomes the passage through which the high temperature exhaust gas generated from the respective combustion chambers is discharged. Therefore, this is to concentrate the flow of the cooling water on the circumference of the exhaust port hole O/H where the exhaust port of the cylinder head will be formed, thereby increasing the cooling efficiency.

The flow guide partition wall 700 according to a first embodiment among the flow guide partition walls 700 formed to increase the flow of the cooling water enclosing the exhaust port hole O/H during the cross-flow has a hexagonal prism shape in which a length in a width direction of the cylinder head is longer than a length in a length direction of the cylinder head. In this case, an area of a side surface of the intake side of the cylinder head of the flow guide partition wall 700 is set to be larger than that of a side surface of the exhaust side of the cylinder head.

The form of the flow guide partition wall 700 as described above may be easily manufactured upon the manufacturing of the cylinder head and increase the flow of the cooling water enclosing the exhaust port hole O/H during the cross-flow.

Further, the flow guide partition wall 700 according to a second embodiment among the flow guide partition walls 700 formed to increase the flow of the cooling water enclosing the exhaust port hole O/H during the cross-flow has a cross section in a V-letter form protruding toward the intake side of the cylinder head.

The form of the flow guide partition wall 700 as described above may be formed to increase the flow of the cooling water enclosing the exhaust port hole O/H during the cross-flow without considering the easiness of manufacturing.

The form of the flow guide partition wall 700 is not limited to the first embodiment and the second embodiment and the flow guide partition wall 700 may further include another form for increasing the flow of the cooling water enclosing the exhaust port hole O/H during the cross-flow.

The lower passage 220 and the upper passage 210 are divided by the upper and lower dividing partition wall 600. The lower passage 220 and the upper passage 210 communicate with each other by bypassing the upper and lower dividing partition wall 600, and as a result the air in the lower passage 220 may be introduced into the upper passage 210 but the upper and lower dividing partition wall 600 serves as the resistance against the flow of the cooling water.

Therefore, most of the cooling water introduced from the intake side inlet passage 100 into the lower passage 220 is not introduced into the upper passage 210 but is discharged to the outlet side outlet passage 300. That is, the flow of the cooling water is concentrated on the lower passage 220 which may directly cool the combustion chamber, thereby increasing the cooling efficiency.

Further, when the air is included in the lower passage 220, the resistance against the flow of the cooling water occurs as much as a volume of the air. Therefore, there is a need to discharge the air included in the lower passage 220. That is, the lower passage 220 and the upper passage 210 communicate with each other by bypassing the upper and lower dividing partition wall 600, and as a result the air in the lower passage 220 is introduced into the upper passage 210. In this case, some of the cooling water may also be introduced into the upper passage 210. Therefore, there is a need to discharge the air and the cooling water introduced into the upper passage 210 as described above.

For this purpose, the upper passage 210 is formed in the length direction of the cylinder head and the air introduced from the lower passage 220 into the upper passage 210 and the cooling water introduced along with the air form the parallel-flow which flows in the length direction of the cylinder head. Further, the upper passage 210 and the cooling water outlet 500 communicate with each other through a ventilation passage 800, such that the air and the cooling water forming the parallel-flow at the upper passage 210 is discharged to the cooling water outlet 500.

In this case, a cross sectional area of the ventilation passage 800 is set to be smaller than a minimum cross sectional area of the upper passage 210. Therefore, the flow rate of the cooling water discharged through the upper passage 210 is minimized and most of the flow of the cooling water passes through the lower passage 220, and as a result the flow of the cooling water is concentrated on the combustion chamber, in particular, the circumference of the spark plug hole S/H and the exhaust port hole O/H which are relatively high temperature, thereby increasing the cooling efficiency.

Figure 6:
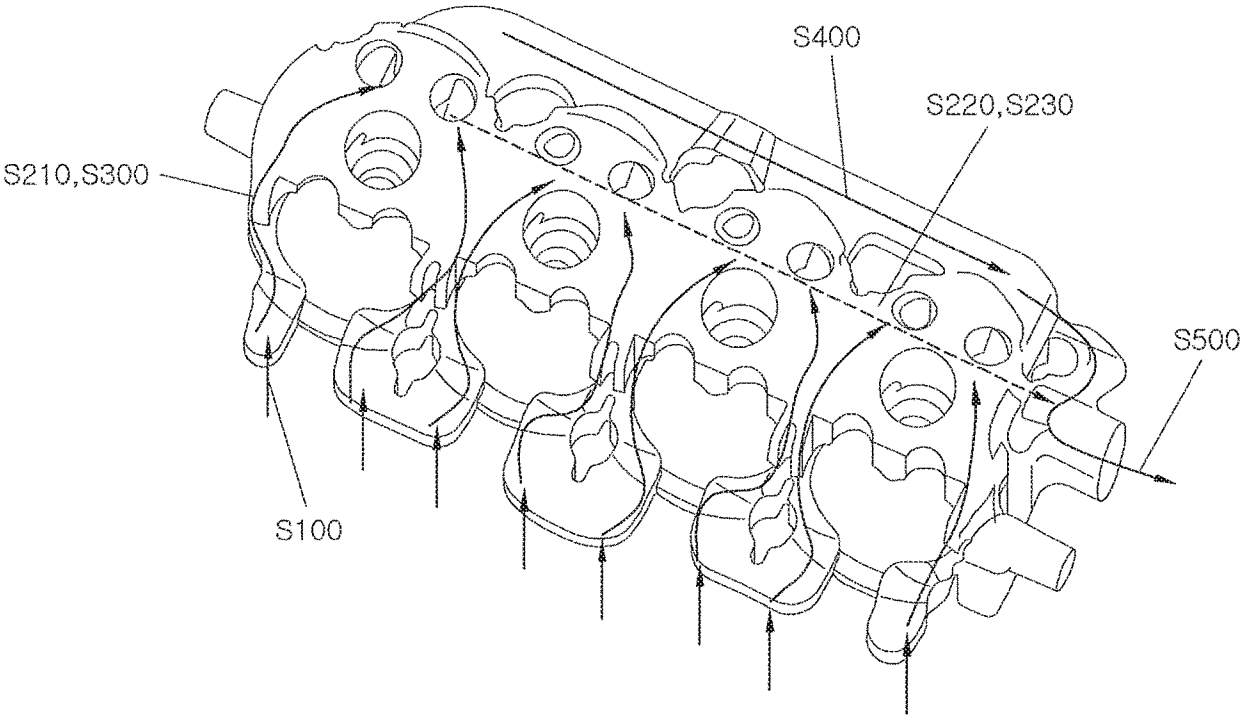
FIG. 6 is an operation state view of a water-jacket structure of a cylinder head according to an exemplary embodiment of the present disclosure.
Figure 7:
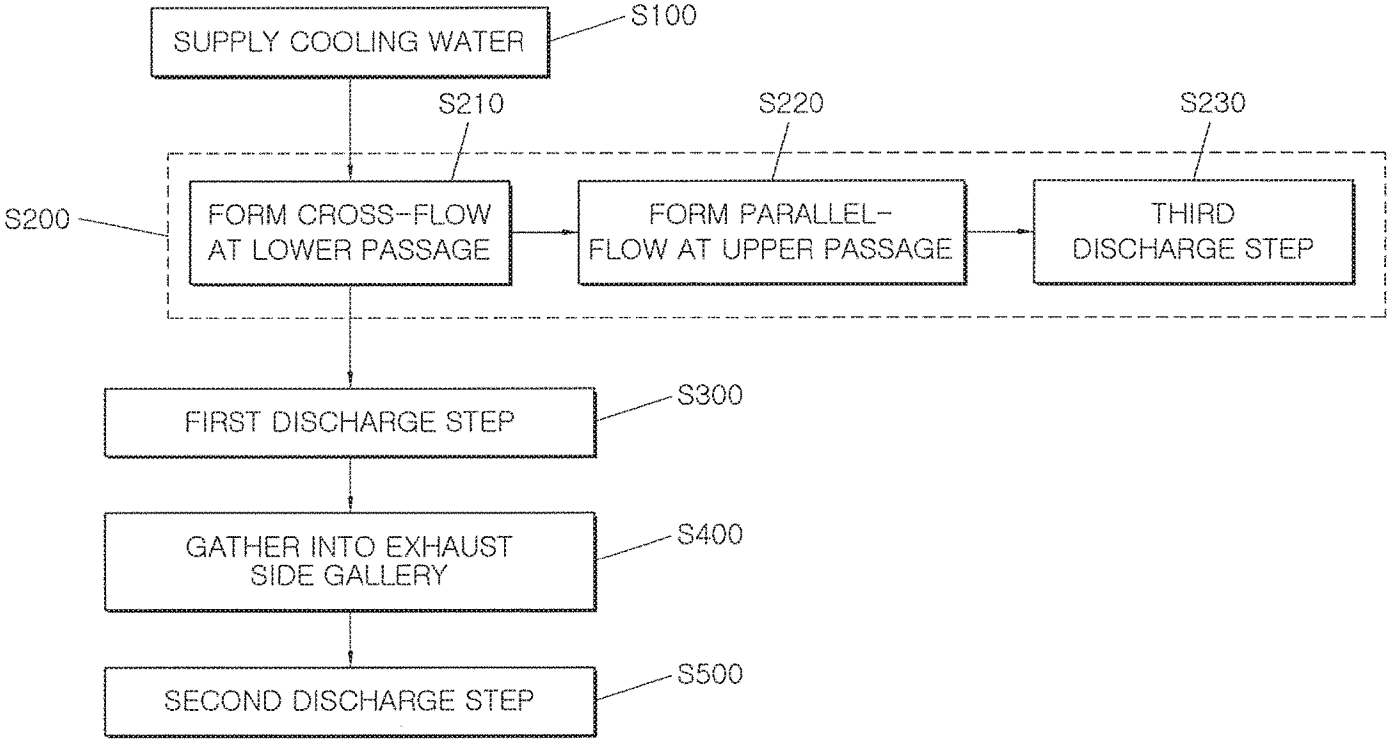
FIG. 7 is a flow chart of a method for operating a water-jacket structure of a cylinder head according to an exemplary embodiment of the present disclosure.

FIG. 6 is an operation state view of a water-jacket structure of a cylinder head according to an exemplary embodiment of the present disclosure, and FIG. 7 is a flow chart of a method for operating a water-jacket structure of a cylinder head according to an exemplary embodiment of the present disclosure. Referring to FIGS. 6 and 7, the method for operating a water-jacket structure of a cylinder head includes: supplying the cooling water to the intake side inlet passage 100 (S100); cooling, by the cooling water supplied from the intake side inlet passage 100, the combustion chamber while passing through the inside of the combustion chamber cooling passage 200 (S200); a first discharge step (S300) of discharging the cooling water passing through the combustion chamber cooling passage 200 through the exhaust side outlet passage 300; and gathering the cooling water discharged from the exhaust side outlet passage 300 into the exhaust side gallery 400 (S400).

The method for operating a water-jacket structure of a cylinder head includes a second discharging step (S500) of discharging the cooling water gathered into the exhaust side gallery 400 to the outside of the cylinder head through the cooling water outlet 500.

The cooling (S200) includes: forming the cross-flow cooling the respective combustion chambers by the flow guide partition walls 700 vertically disposed at both sides of the spark plug hole S/H of the lower passage 220 (S210); forming the parallel-flow making the air introduced from the lower passage 220 into the upper passage 210 by bypassing the upper and lower dividing partition wall 600 and the cooling water introduced along with the air flow in the length direction of the cylinder head (S220); and a third discharge step (S230) of discharging the air and the cooling water forming the parallel-flow from the floating passage 210 to the cooling water outlet 500 through the ventilation passage 800.

As set forth above, according to the exemplary embodiments of the present disclosure, the flow rate of cooling water passing through the circumference of the combustion chamber may be increased by concentratedly cooling the circumference of the combustion chamber (in particular, the circumference of the exhaust port hole) to be cooled.

Further, the deviation in the surface temperature between the respective cylinders may be prevented by reducing the flow resistance and intensifying the cross-flow, thereby efficiently controlling the engine.

The foregoing exemplary embodiments are only examples to allow a person having ordinary skill in the art to which the present disclosure pertains (hereinafter, referred to as those skilled in the art) to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications, and variations can be made without departing from the spirit and scope of the invention as defined by the appended claims and can also belong to the scope of the invention.

What is claimed is:

1. A water-jacket structure of a cylinder head, comprising: a plurality of intake side inlet passages installed at an intake side of the cylinder head along a length direction of the cylinder head to introduce cooling water supplied from a water-jacket of a cylinder block into the water-jacket structure of the cylinder head; a combustion chamber cooling passage cooling a combustion chamber using the cooling water supplied from the plurality of intake side inlet passages; a plurality of exhaust side outlet passages disposed at an exhaust side of the cylinder head along the length direction of the cylinder head to discharge the cooling water passing through the combustion chamber cooling passage; and an exhaust side gallery communicating with the plurality of exhaust side outlet passages to gather the cooling water discharged from the plurality of exhaust side outlet passages, wherein the combustion chamber cooling passage encloses an intake port hole, an exhaust port hole, and a spark plug hole, wherein the combustion chamber cooling passage includes an upper passage and a lower passage that are divided by an upper and lower dividing partition wall, wherein the water-jacket structure further comprises: flow guide partition walls vertically disposed at both sides of the spark plug hole of the lower passage to form a cross-flow in which the cooling water introduced from the plurality of intake side inlet passages into the lower passage flows in a width direction of the cylinder head to cool the combustion chamber and then is discharged to the plurality of exhaust side outlet passages, wherein the flow guide partition walls increase a flow of the cooling water enclosing the exhaust port hole during the cross-flow, and wherein each of the flow guide partition walls has a cross section in a V-letter form protruding toward the intake side of the cylinder head.

2. The water-jacket structure of claim 1, further comprising:

a cooling water outlet communicating with one side of the exhaust side gallery to discharge the cooling water gathered into the exhaust side gallery to an outside of the cylinder head.

3. The water-jacket structure of claim 1, wherein a cross sectional area of each of the plurality of exhaust side outlet passages is larger than that of each of the plurality of intake side inlet passages.

4. The water-jacket structure of claim 2, wherein the lower passage and the upper passage communicate with each other by bypassing the upper and lower dividing partition wall to introduce air from the lower passage into the upper passage.

5. The water-jacket structure of claim 4, wherein the upper passage is formed in the length direction of the cylinder head to form a parallel-flow in which the air is introduced from the lower passage into the upper passage and the cooling water is introduced along with the air flow in the length direction of the cylinder head.

6. The water-jacket structure of claim 5, further comprising:

a ventilation passage through which the upper passage and the cooling water outlet communicate with each other to discharge the air and the cooling water forming the parallel-flow at the upper passage to the cooling water outlet.

7. The water-jacket structure of claim 6, wherein a cross sectional area of the ventilation passage is smaller than a minimum cross sectional area of the upper passage.

8. The water-jacket structure of claim 1, wherein a cross sectional area of the lower passage at each side of the spark plug hole is smaller than that of the lower passage at the intake side of the cylinder head.

9. The water-jacket structure of claim 1, wherein each of the flow guide partition walls has a hexagonal prism shape in which a length in the width direction of the cylinder head is longer than a length in the length direction of the cylinder head.

10. The water-jacket structure of a cylinder head of claim 9, wherein in each of the flow guide partition walls, an area of a side surface of the intake side of the cylinder head is larger than that of a side surface of the exhaust side of the cylinder head.

11. A method for operating a water-jacket structure of a cylinder head, comprising: supplying cooling water to an intake side inlet passage; cooling, by the cooling water supplied from the intake side inlet passage, a combustion chamber while passing through an inside of a combustion chamber cooling passage; a first discharge step of discharging the cooling water passing through the combustion chamber cooling passage through an exhaust side outlet passage; and gathering the cooling water discharged from the exhaust side outlet passage into an exhaust side gallery, wherein the combustion chamber cooling passage encloses an intake port hole, an exhaust port hole, and a spark plug hole, wherein the combustion chamber cooling passage includes an upper passage and a lower passage that are divided by an upper and lower dividing partition wall, wherein the cooling includes forming a cross-flow in which the cooling water introduced into the lower passage in a width direction of the cylinder head cools the combustion chamber by a flow guide partition wall vertically disposed at both sides of the spark plug hole of the lower passage, wherein the flow guide partition wall increases a flow of the cooling water enclosing the exhaust port hole during the cross-flow, and wherein each of the flow guide partition walls has a cross section in a V-letter form protruding toward the intake side of the cylinder head.

12. The method for claim 11, further comprising:

a second discharge step of discharging the cooling water gathered into the exhaust side gallery to an outside of the cylinder head through a cooling water outlet.

13. The method for claim 11, wherein the cooling includes forming a parallel-flow in which air is introduced into the upper passage by bypassing the upper and lower dividing partition wall at the lower passage and in which cooling water is introduced along with the air flow in a length direction of the cylinder head.

14. The method for claim 13, wherein the cooling includes a third discharge step of discharging the air and the cooling water forming the parallel-flow at the upper passage to the cooling water outlet through a ventilation passage.

* * * * *